United States Patent [19]

O'Leary

[11] Patent Number: 4,648,704

[45] Date of Patent: Mar. 10, 1987

[54] METHOD AND APPARATUS FOR APPLYING LIQUID TONER TO A RECORDING MEMBER

[75] Inventor: Kevin J. O'Leary, Rochester, N.Y.

[73] Assignee: Eastman Kodak Company, Rochester, N.Y.

[21] Appl. No.: 802,916

[22] Filed: Nov. 29, 1985

[51] Int. Cl.[4] ..... G03G 15/10

[52] U.S. Cl. ..... 355/10; 118/661; 430/117; 354/318

[58] Field of Search ..... 355/10, 4; 118/661, 118/645; 430/117-119; 354/318; 427/14.1, 27

[56] References Cited

U.S. PATENT DOCUMENTS

| | | | |
|---|---|---|---|
| 3,169,887 | 2/1965 | York | 118/637 |
| 3,203,395 | 8/1965 | Liller | 118/637 |
| 3,256,855 | 6/1966 | Oliphant | 118/637 |
| 3,334,613 | 8/1967 | Young | 118/637 |
| 3,355,288 | 11/1967 | Matkan | 96/1 |
| 3,561,400 | 2/1971 | Smitzer et al. | 118/637 |
| 3,601,092 | 8/1971 | Satami | 118/637 |
| 3,627,410 | 12/1971 | Jugle | 355/4 |
| 3,667,841 | 6/1972 | Ross | 355/4 |
| 3,682,082 | 8/1972 | Stievenart | 354/318 |
| 3,774,574 | 11/1973 | Sato et al. | 118/637 |
| 3,790,375 | 2/1974 | Brock | 96/1 R |
| 4,176,940 | 12/1979 | Katakabe et al. | 355/10 |
| 4,179,210 | 12/1979 | Bestenreiner et al. | 355/10 |
| 4,189,226 | 2/1980 | Yamaguchi et al. | 355/10 |
| 4,264,185 | 4/1981 | Ohta | 355/4 |
| 4,271,785 | 6/1981 | Dinallo et al. | 355/10 X |
| 4,294,192 | 10/1981 | Nakai et al. | 118/650 |
| 4,398,497 | 8/1983 | Matkan | 118/661 |
| 4,493,550 | 1/1985 | Takekida | 355/10 |

*Primary Examiner*—R. L. Moses

*Attorney, Agent, or Firm*—Dennis R. Arndt

[57] ABSTRACT

Method and apparatus for applying liquid dispersed toner to the surface of an electrographic recording member, held on a platen which moves relative to a pair of coplanar cylindrical developing electrodes. Toner is deposited on the recording member by passing the record member over a projecting portion of each of the cylindrical developing electrodes in contact with a film of fluid established by the rotating coplanar cylindrical developing electrodes. The fluid has dispersed toner entrained therein and is supplied to the rotating cylinders by a pump which forces the liquid between each rotating cylinder and the shroud which surrounds the roller, except for an opening through which a projecting portion of each cylinder extends above its respective shroud. A dam connects the adjacent portions of the shrouds to collect additional fluid during the operation thereof and provides an elevated toner meniscus above and between the rotating cylinders, increasing the area of the fluid in the processing nip substantially. Wiper blades are provided along the length of each cylinder to remove residual material from the cylinders to insure that a renewed surface on each of the cylindrical developing electrodes is presented to the recording member.

11 Claims, 6 Drawing Figures

METHOD AND APPARATUS FOR APPLYING LIQUID TONER TO A RECORDING MEMBER

BACKGROUND OF THE INVENTION

1. Field of the Invention

This invention relates to liquid developing apparatus used to deposit electroscopic toner particles dispersed in a fluid onto the surface of a moving recording member in accordance with a latent electrostatic image formed thereon, and more particularly to such an apparatus which applies the liquid developer only to one surface of the recording member.

2. Description of the Art

Several techniques are known for applying electroscopic toner to latent electrostatic image bearing record members so that toner will adhere to the record member in desired areas to develop the image. One technique is by cascading the particulate toner in dry form onto the surface of the record member, and removing the excess toner either by allowing it to slide off the record member by the force of gravity, or by blowing the excess toner with a fan. Another technique is to entrain the toner particles in a finely divided magnetic powder and to use a magnetic brush for distributing the toner over the surface of the record member. A third technique for distributing the toner is to entrain the toner in a dielectric liquid which is then brought in contact with the surface bearing the latent image. The developer apparatus of the present invention utilizes the latter technique.

A significant problem encountered in developer apparatus that uses liquid entrained toner is commonly known as "boundary layer depletion". This may occur even after a very short period of use, since the concentration of toner in the liquid near where the liquid is brought into contact with the recording member may lower very rapidly when developing a "dark area" of the latent image.

Other than the total emersion of the recording member in the liquid entrained toner for the purpose of development, which was not very effective with flat record members, there has existed the problem of supplying an adequate concentration of toner to ensure complete development. One of the earliest attempts to solve this problem was to use a roller dipped into a liquid toner bath. The roller, which was also conducting, was then rotated to provide a sufficient turbulent action to the liquid to provide a constant changing and replenishing action to the liquid entrained toner at the processing nip. Such an apparatus is illustrated in U.S. Pat. No. 3,367,791, entitled LIQUID DEVELOPMENT OF ELECTROSTATIC IMAGES.

As processing speeds increased, equipment modifications were required to keep pace with the increased through-put. It was found that as the recording member was passed over a rotating developing electrode, the developing zone was relatively small and that effective development was limited by the volume of liquid dispersed toner that the rotating electrode could deliver to the processing nip. By placing a plurality of rotating electrodes in tandem, the volume of toner liquid could be substantially increased so that the speed at which the recording member moves could be increased. The image is fully developed gradually by building up small amounts of toner particles supplied by the successive rotating electrodes. An example of developing apparatus of this type may be found in U.S. Pat. No. 3,774,574.

However, such a development apparatus would occupy substantially more space than apparatus that used single rotating electrodes, especially in a color apparatus that would require as many as four independent developing applicator sections for three colors and a fourth for black or neutral density.

With the advent and popularity of color images produced by electrophotographic means there resulted in an increase in the minimum distance between the recording member and the applicator which may be termed the "image gap", which consists of the total thickness of all the multi-step toners that are capable of being applied to a recording member to create a composite color image. Thus when a large image gap is involved, the thin layer of liquid dispersed toner that adheres to a cylindrical development electrode would not make contact with each of the images to be developed. Such a smooth-surfaced applicator is capable of supporting a liquid developer meniscus of about 0.015" thickness due to the low viscosity of conventional liquid developers and the smooth nature of the roller. When a large film-to-roller spacing is required e.g. 0.050", the liquid developer would not make contact with the film.

U.S. Pat. No. 3,561,400 relates to an improved apparatus that attempted to solve many of the problems mentioned above. Generally, the apparatus comprises a shroud that surrounds a cylindrical roller. The shroud has an opening therein which permits a portion of the roller to project beyond the shroud. A pump provides a supply of liquid entrained toner into the space between the roller and the shroud. The roller is rotated to carry a film of the developer liquid over the projecting portion of the roller to contact the record bearing members.

Thus, it can be seen that any attempt to increase the through-put of apparatus that produces color images requiring a large image gap would result in drastically increasing the diameter of the rotating electrode to obtain an adequate electric field as well as the proper developing zone.

SUMMARY OF THE INVENTION

It is an object of the present invention to provide an improved apparatus for developing a latent electrostatic image on a flat recording member.

This object is achieved by using a pair of cylindrical electrode rollers with a shroud surrounding each roller so as to define a space between each roller and its respective shroud. Each shroud has an opening to permit the upper portion of the roller to project beyond its respective shroud. Means are provided for continuously supplying liquid toner to the space around each roller and to force the liquid upwardly between the shroud and the roller. Extending between adjacent portions of the shroud is a dam in which liquid toner is allowed to collect during operations. A motor rotates the rollers which are cleaned by a wiper blade preventing accumulation of toner particles on the surface of the rollers so that a clean electrode is always presented to the recording member.

The use of two smaller diameter rollers are more desirable than one larger diameter roller of the type shown in the prior art. In order to get a comparable electric field, the larger diameter roller would have to be at least four times the diameter of the smaller roller, resulting in much wasted space. Use of two shroud configurations side-by-side connected by a dam provides the same processing length as the larger roller without the wasted space associated with the larger roller. The configuration set forth in this invention also allows running the development process with less concentrated dispersant, thereby allowing the developed image to have an improved background density.

DESCRIPTION OF THE DRAWINGS

A better understanding of the present invention and its organization and construction may be had by referring to the description below in conjunction with the accompanying drawings wherein.

DETAILED DESCRIPTION

Figure 1:
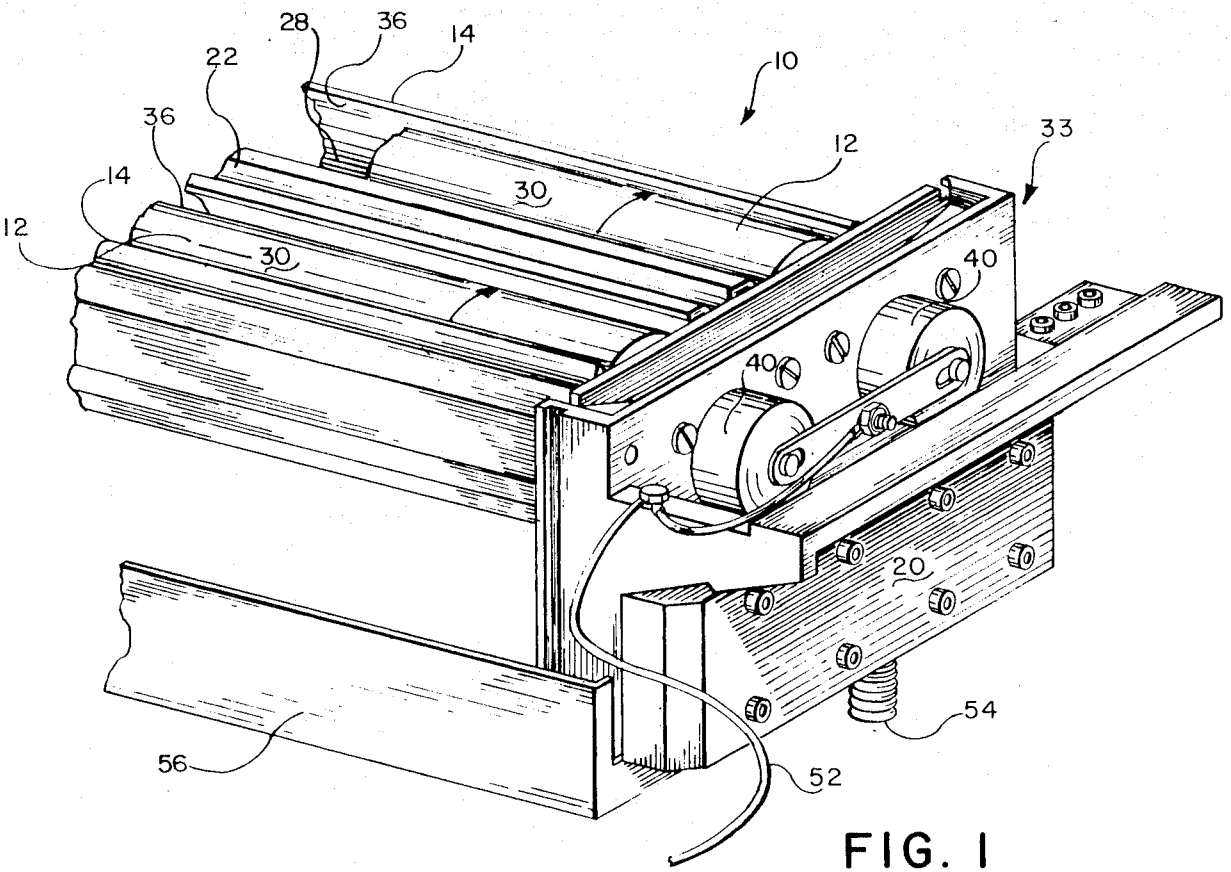
FIG. 1 is a perspective view of the electrophotographic development apparatus of the present invention.
Figure 2:
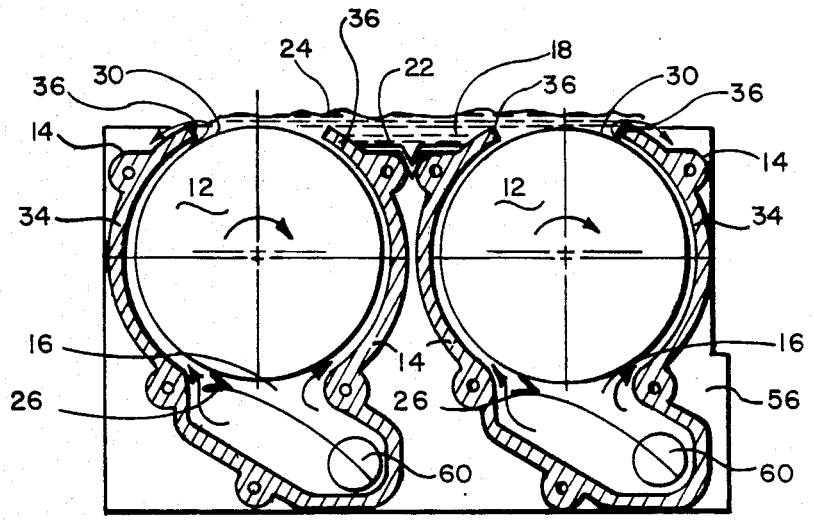
FIG. 2 is a sectional view of the development apparatus of this invention showing the same filled with toning liquid.
Figure 3:
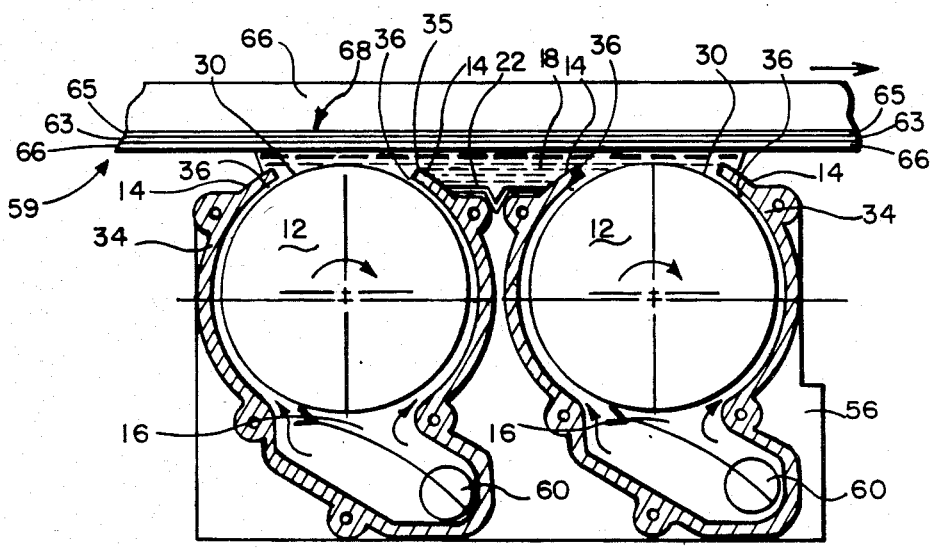
FIG. 3 is a sectional view of the development apparatus showing the same filled with toning liquid and in operating condition with a record member being processed.

Referring now to the drawings in greater detail, FIGS. 1–3 thereof show perspective and end sectional views of a preferred embodiment of a liquid developing apparatus 10 according to the invention.

Figure 4:
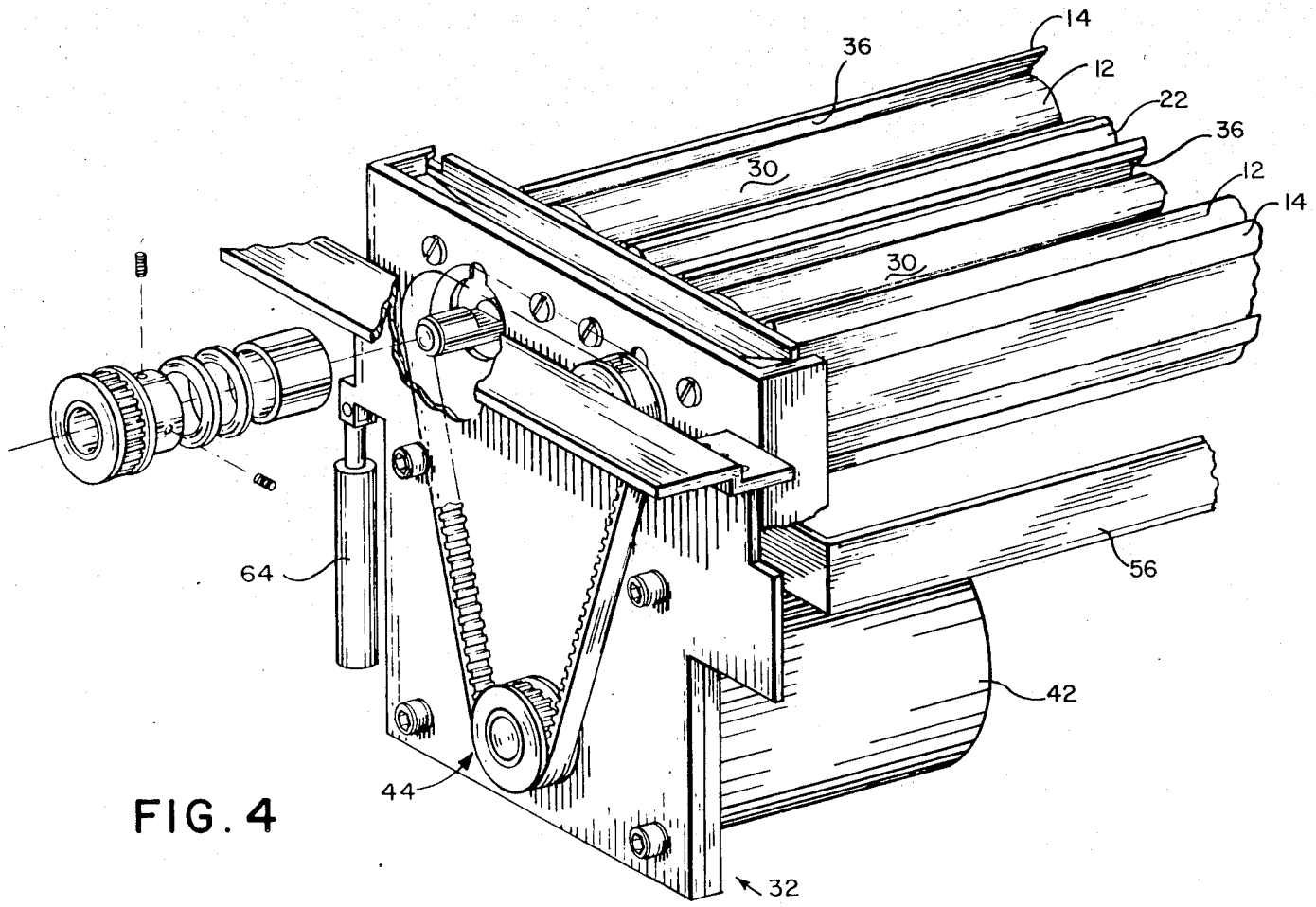
FIG. 4 is an exploded perspective view looking from a first end of the development apparatus illustrating the internal parts in more detail.

In general, the liquid development apparatus 10 of the invention comprises a pair of cylindrical rollers 12. A shroud 14 surrounds each roller 12 and defines a space 16 between the rollers 12 and the respective shroud 14. The shrouds 14 are formed of an extruded aluminum having a black anodized finish, and each surrounds a roller 12 except for an elongated slot or opening 28 at the top of the shroud 14. The roller 12 is therefore almost completely encompassed by the shroud 14 except for a small portion of the roller surface 30. Approximately a 60 degree segment of the roller extends through the slot or opening 28 in the shroud 14. First and second end pieces 32 and 33 respectively close the openings in the ends of the shroud so that liquid toner 18 is contained within the space 16. Each shroud 14 is designed to form a tapered space 34 on opposite sides of roller 12. This tapered space 34 creates a backpressure within the shroud 14 which results in a more uniform flow of liquid past the openings 36 on either side of each roller 12. Each roller 12 is mounted on a shaft 38 which is journaled in bearings 40 mounted in the first end piece 32. The shafts 38 are driven by a motor 42 via a suitable drive mechanism 44 located on a first end 32 as best seen in FIG. 4. Means (not shown) provide a supply of liquid entrained toner 18 to a manifold 20 which in turn directs the liquid into the space 16 between the roller 12 and surrounding shroud 14. The rollers 12 are rotated at about 35 rpm while a film of liquid toner 18 builds up over the projecting portion of the roller 12 as the liquid toner is forced upwardly between the shroud 14 and the roller 12.

The liquid toner 18 that flows over the sides 37 of the shrouds 14 that are adjacent each other are collected by a dam 22. The dam 22 prevents the liquid from draining in between the two shrouds 14. This dam 22 assists in elevating the meniscus 24 of toner 18 on top of the rollers 12, and this has been found to be especially useful with non-viscous low concentration toners.

The liquid toners consist of pigmented, insoluble particles, having diameters up to 2 microns, that are stabilized in ISOPAR G® (Reg. Trademark for the Humble Oil & Refining Company) a nonpolar, branched, liquid hydrocarbon. The pigmented particles are positively charged and are thus attracted to the areas of the film which, as a result of the charging and exposure, are more electrically negative than the particles. To process a color image, four developers are required, one for each of the three process colors: cyan, magenta, yellow and black. One developing apparatus having two rotating cylindrical rollers and a dam would be used for each color.

The deep meniscus 24 allows the surface with the latent image to be further away from the surface of the roller 12, e.g. approximately 0.050 inches. This increased distance can be used to accommodate varying image package 59 thickness. The image package 59 is the combination of the photoconductor film 66, separation negative 63 and mask 65. There is also more toner particles available for imaging in the deeper meniscus 24 resulting from the dam 22. Toned density is dependent upon three factors—toner contact time, the concentration of the toner and the electrical field. With the deeper meniscus 24, very even toner contact is established over the length of the rollers 12. It has also been found that with improved electric field, satisfactory toning occurs when using low concentration toners which results in an improved background. Small weep holes (not shown) in the bottom of the dam 22, allow the liquid toner in the dammed area to drain when the development apparatus is not in operation.

Experience in development with toners of various concentrations have shown that the use of lower concentration toners forces a tradeoff between increased development time and superior images.

Images developed using lower concentration toners have a cleaner background or D min area in the toned image. In addition, lower concentration toners are capable of developing small image detail with greater density and sharper edges. Thus, the developed images have high resolution and better contrast when lower concentration toners are used. Another benefit associated with the use of lower concentration toners is a reduction in the buildup of chemical deposits on the development electrode, as well as other parts in the plumbing thereof affording a substantial reduction in routined maintenance.

Clearly, there are many advantages in using lower concentraton toners. However, lower concentration toners require more development time or dwell time when used in prior art development heads. Increased development head efficiency of the present invention would also allow the use of lower concentration toners, and still achieve aim densities.

FIG. 2 illustrates in section the apparatus for developing latent electrostatic images. The roller 12 is made of a conductive material such as aluminum and has its surface treated with an oxidizing hard coat. This is an electro-chemical process which produces a thick, hard dielectric surface on aluminum. A 1-to-2 mil hard coat provides a very hard corrosion-abrasion-resistant film surface to the metal that is generally used for heavy wear applications. Teflon ® (Reg. Trademark of E. I. duPont de Nemours & Co., Inc. for tetrafluoroethylene resins) is applied to the hard coat by vacuum or pressure can spraying to the roller surface 30. The purpose of the hard coat is to give the roller durability while the Teflon ® impregnation reduces roller surface friction with the wiper blade 26, to be discussed later. This coating (hard coat and Teflon ®) on the roller is a non-conductor, but it has not been found to be detrimental to the process. The length of the roller is equal to or greater than the greatest width of the record bearing member in this instance, approximately 31 inches in length.

Figure 5:
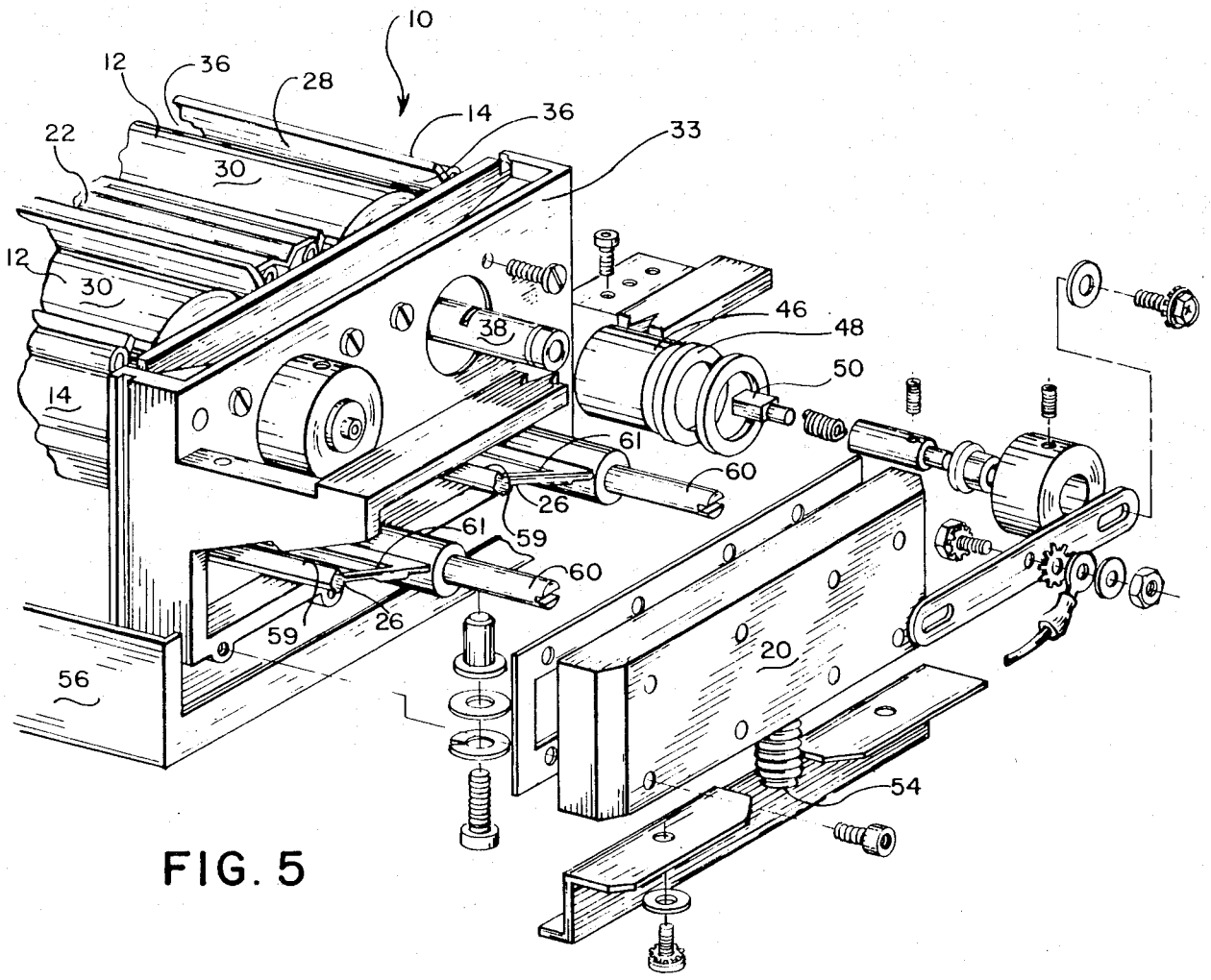
FIG. 5 is an exploded perspective view looking from a second end of the development apparatus illustrating the internal parts in more detail.

Referring to FIG. 5 which illustrates the second end 33 of the apparatus 10 where it can be seen that the roller shafts 38 are journaled within a bearing 46 and seal assembly 48 held by the second end 33. Bias is applied to each roller via a contact brush assembly 50 (for the sake of simplicity, only one roller shaft 38 is illustrated, with the attachment to the other roller being identical to the one shown) which maintains electrical contact between the roller and a power supply (not shown) which is connected by wire 52 to the assembly 10.

The density created by a development head is directly proportional to the voltage difference between the development head and the record member. To control the density of the image accurately, that development potential difference ($\Delta V$) must be controlled accurately. It is intended that in this apparatus $\Delta V$ be controlled to within one volt by measuring the potential on the record member. The development bias precision achieved results from using a programmable power supply to bias the rotating cylindrical development electrodes instead of grounding it. This allows the background density D min of the image and the dot area to be held within close tolerances. Use of a grounded development head limits one to charging in one polarity only.

Liquid toner 18 is delivered to the feed manifold 20 through the input tube 54 under very slight pressure by a pump, not shown. The feed manifold 20 distributes liquid toner 18 to the space 16 between the rollers 12 and shrouds 14. The liquid toner 18 is then gently forced up between the four openings 36 between the rollers 12 and the shrouds 14. Liquid that overflows between the adjacent or inboard sides of the shrouds 14 is collected by dam 22 as mentioned earlier. Liquid that overflows the outboard sides of the shrouds 14 is collected by a catch tray 56 (see FIGS. 4 and 5) from which it is allowed to drain into a sump (not shown) where it may be replenished and returned to the feed manifold 20 via a pump, not shown. It should be noted that the previously mentioned weep holes in the collecting means or dam 28 also drain liquid toner 18 into the catch tray 56.

Figure 6:
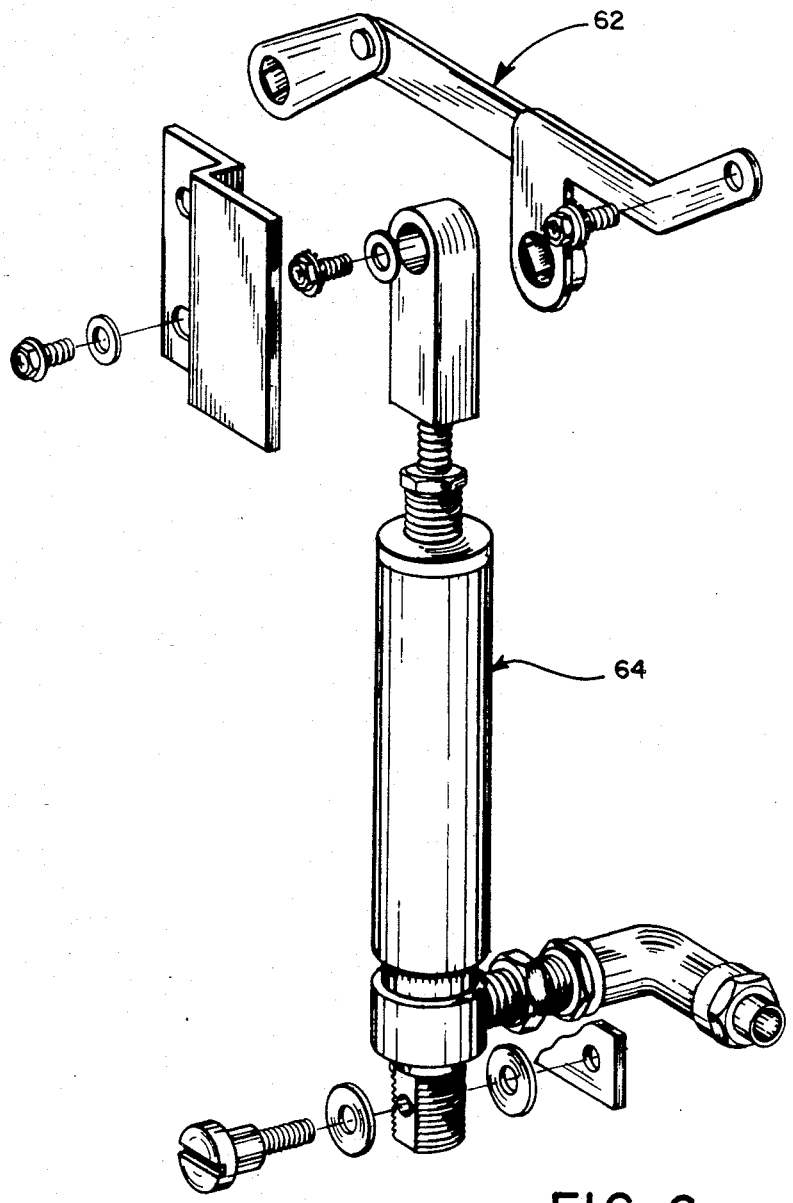
FIG. 6 is a perspective view of an air piston and linkage used to activate the wiper blades illustrated in FIGS. 2, 3, and 5 against the developer rollers.

A bias as mentioned earlier is applied by wire 52 to the shrouds, rollers and dam 22. The toning particles that are entrained in the liquid are then driven by the electric field that is established by this bias. Depending upon the charge of the toning particles, the type of image being processed and the direction of the field, particles can plate onto the surface 30 of the rollers 12. A build up of toner particles on the surface 30 of the rollers 12 will adversely affect the electric field. In an effort to eliminate such a problem, a wiper blade 26 is used in association with each roller 12 to remove any accumulations of toner from the surface of that roller. The wiper blades 26 may be seen in FIGS. 2, 3 and 5. Each wiper blade 26 has a polyurethane edge 59 molded onto a fiberglass backing 61 which is attached to a shaft 60 which runs the length of the roller 12. The wiper blades 26 may be selectively moved into and out of engagement with the rollers 12 by means of a linkage assembly 62 which is connected to the shafts 60 and is actuated by an air piston 64 illustrated in FIG. 6. The action of the wiper blades 26 against the rollers removes the accumulated toner particles from the surface of the rollers and remixes them into the dispersant.

After the photoconductive record member 66 carrying the electrostatic latent image has been oriented to face downward on the platen 70 and after having been charged and exposed, the image is ready for development. The platen holding the record member 66 is then translated (in the direction of the arrow in FIG. 3) across the developing apparatus 10. The platen 70 is supported by wheels that move along a fixed track (not shown) so as to maintain the latent image bearing surface of the record member 66 a fixed distance above the development apparatus 10, approximately 0.05 inches, commonly called the "toning gap". The top portion of the rollers 12 move in the same direction as the moving platen with a tangential velocity about 1.5 times the speed of the platen. There is a slight advantage to the rollers rotating in the same direction as the platen because the action of the wiper blade 26 in removing any toner particles that may have plated onto the surface of the roller. Action of this wiper blade results in the presentation of a renewed surface of the roller to the latent image on the record member.

As best illustrated in FIG. 3, one can observe that the zone of development, which is the total area of the latent image that is contacted by the elevated toner meniscus 24, is substantially increased with the incorporation of collecting means such as dam 22. As a result, a greater amount of toner is present within the development zone, thereby reducing the chance that toner may become locally depleted within the zone as a result of the patterns present in the latent image that would require excessive amounts of toner.

It should be understood that variations are capable of being made without departing from the spirit or scope of the invention as defined in the appended claims. For example, one may manufacture a single casting that would form the equivalent of two shrouds with the collecting means formed in the same piece between the integrally formed shrouds.

What is claimed is:

1. Apparatus for the application of liquid toner to the surface of an electrographic record bearing member comprising a platen support member for an electrographic record member and developing electrode spaced from said platen member to form a toning gap, said platen member and said developing electrode being movable with respect to each other said apparatus comprising:

said developing electrode including at least a pair of cylindrical rollers;

a shroud surrounding each of said rollers so as to define a space between each roller and its respective shroud;

each shroud having an opening therein permitting a portion of a roller to project beyond its respective shroud;

means for providing a continuous supply of liquid toner into the space around each roller and to force said liquid into the space around each roller and to force said liquid upward between the shroud and said roller;

collecting means extending between adjacent portions of said shrouds in which liquid toner is allowed to collect during operation;

said motion between said platen and the developing electrode allowing contact of said platen with the film of liquid toner above said rollers and with the collected toner between said shrouds.

2. The invention according to claim 1 wherein the developing electrode means further includes said shroud and said collecting means which are all biased at the same potential.

3. The invention according to claim 1 wherein said rollers are comprised of electrically conductive material.

4. The invention according to claim 1 wherein the shape of the space between each roller and its respective shroud is tapered.

5. The invention according to claim 1 that further includes deposit removing means for each roller.

6. The invention according to claim 5 wherein said deposit removing means is a wiper blade movable into and out of engagement with each roller.

7. The invention according to claim 6 wherein said rollers are rotated in a direction to cause the top portion to move in the same direction as said record member.

8. The invention according to claim 1 wherein the length of said rollers is greater than the greatest width of the record bearing member.

9. The method for the application of liquid toner to the surface of an electrographic recording member consisting in the steps of:

(a) positioning said electrographic recording member on a flat platen support member arranged for relative movement over at least a pair of coplanar rotating cylindrical electrodes, each partially surrounded by a shroud with adjacent portions of said shrouds being connected by collecting means which form with said platen member a developer gap;

(b) providing a flow of liquid toner to each shroud and forcing said toner upward around the respective rotating cyindrical electrodes and into said collecting means; and (c) moving the platen member with respect to said developer electrodes.

10. The method as claimed in claim 9 where the method further includes the step of providing a deposit removing device that may be applied to the surface of said cylindrical electrodes along their entire length.

11. Development apparatus for the application of liquid toner to the surface of an electrographic record bearing member, comprising:

a pair of parallel rotatable cylindrical rollers;

shrouds surrounding said rollers and mounted to define a space between each roller and its respective shroud;

each shroud having an opening therein through which a portion of the periphery of a roller projects into operative liquid applying relation to a record bearing member;

means associated with said shrouds for receiving liquid toner into the space around each roller and onto said portion of each roller to form a meniscus of toner between such roller and such record bearing member;

collecting means extending between said shrouds for collecting liquid toner which overflows from the roller meniscus and for supporting the collected toner in contact with said record bearing member, thereby providing a further meniscus of toner between the collecting means and the liquid bearing member to enhance development of the member.

* * * * *